US005226267A

United States Patent [19]

D'Antonio et al.

[11] Patent Number: 5,226,267

[45] Date of Patent: * Jul. 13, 1993

[54] ACOUSTICAL DIFFUSING AND ABSORBING CINDER BLOCKS

[75] Inventors: Peter D'Antonio, Largo, Md.; John H. Konnert, Reston; Jorge E. Pardo, both of Reston, Va.

[73] Assignee: RPG Diffusor Systems, Inc., Upper Marlboro, Md.

[ * ] Notice: The portion of the term of this patent subsequent to Oct. 23, 2007 has been disclaimed.

[21] Appl. No.: 781,385

[22] Filed: Oct. 23, 1991

[51] Int. Cl.[5] ..... E04B 1/82

[52] U.S. Cl. ..... 52/144; 181/285; 181/286; 181/288

[58] Field of Search ..... 52/144; 181/285, 286, 181/288

[56] References Cited

U.S. PATENT DOCUMENTS

| | | | |
|---|---|---|---|
| 4,160,491 | 7/1979 | Matsumoto et al. | 181/284 |
| 4,244,439 | 1/1981 | Wested | 181/210 |
| 4,562,901 | 1/1986 | Junger et al. | 181/285 |
| 4,821,839 | 4/1989 | D'Antonio et al. | 181/198 |
| 4,964,486 | 10/1990 | D'Antonio et al. | 181/285 |
| 5,027,920 | 7/1991 | D'Antonio et al. | 181/285 |

*Primary Examiner*—Carl D. Friedman
*Assistant Examiner*—Matthew E. Leno
*Attorney, Agent, or Firm*—H. Jay Spiegel

[57] ABSTRACT

Disclosed are a variety of structural acoustical cinder blocks including locking blocks which are intended to be assembled together through the use of mortar to provide a diffusor of desired shape and configuration. Each diffusor includes a plurality of wells, the depths of which are determined through the use of number theory sequences, such as, for example, the quadratic-residue sequence developed by Karl Frederick Gauss. The surface irregularities formed in the blocks are unique in that they provide a flat power spectrum and constant scattered energy in the diffraction directions. Each of the blocks including wells also includes a low frequency sound absorbing chamber. The blocks are installed such that there is a stacked bond on the diffusing face and a running bond on the structural rear face. If desired, a single block may be made which includes an entire sequence of wells and dividers.

15 Claims, 2 Drawing Sheets

ACOUSTICAL DIFFUSING AND ABSORBING CINDER BLOCKS

BACKGROUND OF THE INVENTION

The present invention relates to acoustical diffusing and absorbing cinder blocks. Acoustic diffusors are known per se. In this regard, reference is made to the following patents issued to co-applicants D'Antonio and Konnert: U.S. Pat. Nos. D291,601 issued Aug. 25, 1987, 4,964,486 issued Oct. 23, 1990 and 5,027,920 issued Jul. 2, 1991. Furthermore, co-applicants D'Antonio and Konnert are also applicants in U.S. Pat. No. 4,821,839 issued Apr. 18, 1989 which discloses a sound absorbing diffusor using the quadratic-residue number theory as well as sound absorbing materials to absorb sound in a controlled manner. Applicants D'Antonio and Konnert are also patentees of U.S. Pat. No. D306,764 which is directed to an acoustical diffusor having a plurality of wells of approximately square cross-section.

While U.S. Pat. Nos. 4,964,486 and 5,027,920 describe acoustical diffusors made of cinder blocks, these references fail to include various aspects of the present invention including the use of a third overlapping locking block, the use of reinforcing rebar and the provision of low frequency sound absorbing chambers.

Further, Applicants are aware of a product sold under the Trademark "SOUNDBLOX" which resembles cinder blocks and which includes slots therein not made in accordance with the number theory sequences. While "SOUNDBLOX" are provided for sound absorption purposes, they have no disclosed or intended sound diffusing characteristics. They include narrow openings allowing entry into internal chambers designed to absorb sound and control reverberation. While such structures, generally speaking, are incorporated in the present invention, the present invention contemplates devices which also include important diffusing characteristics.

SUMMARY OF THE INVENTION

The present invention relates to acoustical diffusing and absorbing cinder blocks. The present invention includes the following interrelated objects, aspects and features:

(A) The present invention includes a plurality of cinder blocks having structure thereon designed to allow the cinder blocks to be combined together to create acoustical diffusors.

(B) A first such block includes structure allowing interlocking with adjacent blocks as well as an internal chamber accessible by an elongated slot. This block also includes a plurality of wells and dividers. The internal chamber comprises a low frequency sound absorber.

(C) A second block includes interlocking structure allowing interlocking with adjacent blocks as well as an internal chamber having an access slot. The internal chamber consists of a further low frequency sound absorber. This block also includes wells and dividers which combine with the wells and dividers of the first-mentioned block as well as other blocks which are integrated therewith to provide a sound diffuser.

(D) A third block used in accordance with the teachings of the present invention is designed to fit into cavities formed by two adjacent blocks of the types described above to allow all of these blocks to be interlocked together. The interlocking structure of the blocks made in accordance with the teachings of the present invention also includes cavities and passageways designed to allow receipt of both mortar and reinforcing rebar.

(E) In a further aspect, if desired, a single block may be formed which consists of a single cinder block diffusor having all of the required wells and dividers as well as the low frequency absorbing chambers described above.

(F) The diffusors made in accordance with the teachings of the present invention include a plurality of wells, the respective depths of which are determined through operation of the quadratic-residue number theory sequence. The wells are of substantially equal widths as compared to one another and create a phase grating. The quadratic-residue number theory sequence is based upon a formula, $n^2$ (modulo N) where N is a prime number, developed by Karl Frederick Gauss. The explanation set forth in U.S. Pat. No. 4,964,486 is hereby incorporated by reference herein.

As such, it is a first object of the present invention to provide acoustical diffusing and absorbing cinder blocks.

It is a further object of the present invention to provide diffusing cinder blocks having the further provision of internal chambers providing low frequency sound absorption.

It is a yet further object of the present invention to provide such blocks with structural features best facilitating installation while maintaining structural integrity.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
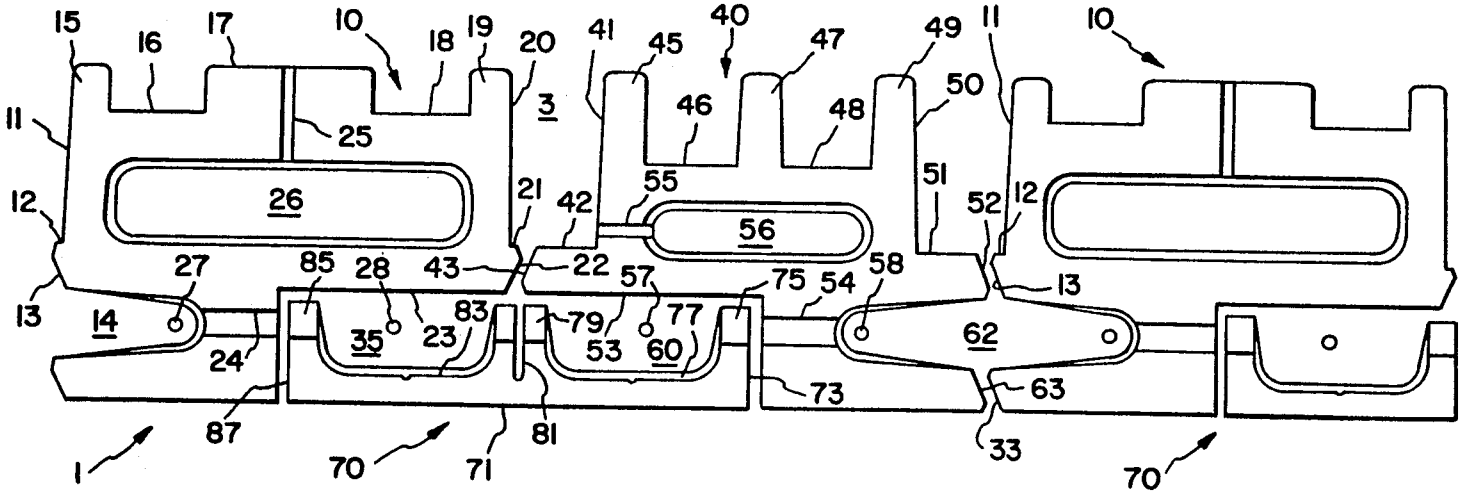
FIG. 1 shows a cross-sectional view through a first embodiment of an acoustical diffusor and absorber made in accordance with the teachings of the present invention.

With reference, first, to FIG. 1, a diffusor made in accordance with the teachings of the present invention is generally designated by the reference numeral 1 and is seen to include two blocks designated by the reference numeral 10, one block designated by the reference numeral 40 and two blocks designated by the reference numeral 70. Of course, if desired, a single block having all of the features of the blocks illustrated in FIG. 1, and for that matter, FIG. 2, may be provided so that a single block comprises an entire diffusor with an entire sequence of wells and dividers.

The blocks designated by the reference numeral 10 are identical to one another and, as such, the block 10 which is most leftward in FIG. 1 will be described in great detail with this description also applying to the other block 10.

The block 10 includes a side wall 11 which, as will be understood in greater detail hereinafter, forms a well of a diffusor sequence in conjunction with an adjacent block 40. The wall 11 terminates in a shoulder 12 which leads to a beveled portion 13 configured to engage an adjacent block 40. Adjacent to the beveled portion 13, a cavity is formed which is intended to receive mortar 14 and a rebar rod 27. This cavity leads to a passageway 24 sized and configured to receive a rebar rod (not shown) which, as will be described in greater detail hereinafter, may extend throughout all interlocked blocks.

With further reference to the blocks 10, the blocks 10 also include a plurality of dividers 15 and 19 along with wells 16 and 18 and a surface 17 which not only comprises dividers but also a well of "0" depth. The divider 19 has, adjacent thereto, a wall 20 which combined with the shoulder 21 and structure of the adjacent block 40 provides a further well. Additionally, beveled surface 22 is designed to interact with beveled surface 43 on the adjacent block 40 when the blocks are assembled together. A wall 23 defines a cavity 35 which may contain mortar as well as a rebar rod 28.

Figure 3:
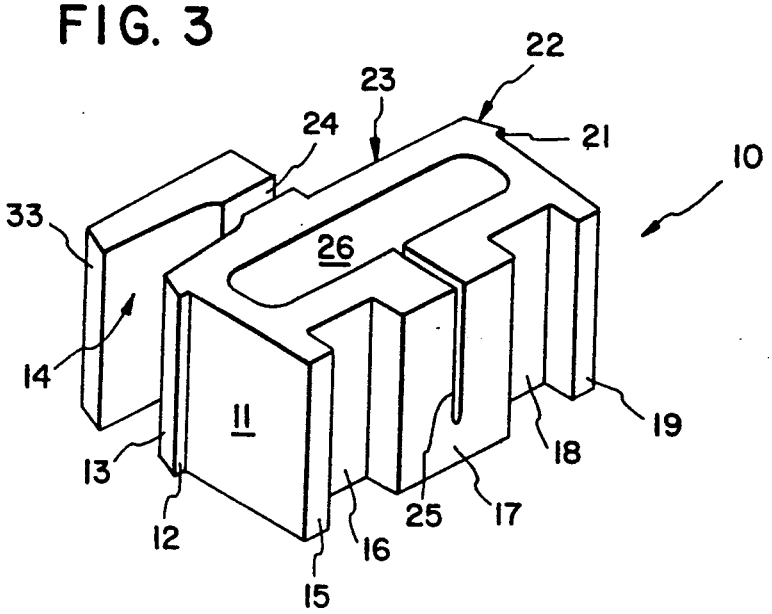
FIG. 3 shows an isometric view of a first block of the present invention.

The block 10 further includes a chamber 26 accessible through an elongated slot 25, which chamber 26 comprises a low frequency sound absorbing chamber. The chamber 26 is shown in FIG. 3 as upwardly open. On the opposite face of the block 10 (not shown), the chamber 26 may be open or closed. As particularly seen in FIG. 3, a further beveled wall 33 cooperates with an adjacent block in the same manner as the beveled wall 13.

Figure 4:
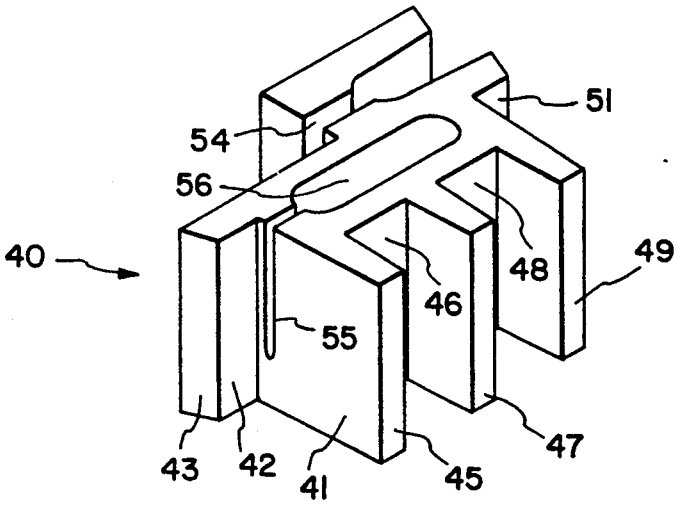
FIG. 4 shows an isometric view of a second block in accordance with the teachings of the present invention.

With reference to FIGS. 1 and 4, the block 40 is seen to include a side wall 41 and a shoulder 42 which combine together with the wall 20 and shoulder 21 of the block 10 to provide a deep well. The beveled wall 43 cooperates with the beveled wall 22 of the block 10 when the blocks 10 and 40 are mounted in adjacency. The wall 53 combines with the wall 23 of the block 10 to define a chamber sized and configured to receive a block 70. A passageway 54 is axially aligned with the passageway 24 in the block 10 so that a rebar rod (not shown) may be inserted through these passageways 24, 54. The rod is small enough in diameter that the rods 28 and 57 will not impede its insertion through these passageways.

With further reference to FIGS. 1 and 4, the block 40 includes dividers 45, 47 and 49 as well as wells 46 and 48. Additionally, the wall 50 and shoulder 51 combine together with the wall 11 and shoulder 12 of the block 10 to comprise a further deep well. The beveled wall 52 cooperates with the beveled wall 13 of the block 10 when these blocks are mounted in adjacency. In a similar way, the wall 63 cooperates with the wall 43 of the block 10 when the blocks 10 and 40 are mounted in adjacency. A cavity 62 formed by cavity halves of the blocks 10 and 40 contains mortar as well as rebar rods such as the rod 58.

A low frequency sound absorbing chamber 56 has access to sound via the slot 55 and the well 3 formed between the blocks 10 and 40. As shown in FIG. 4, the chamber 56 is upwardly open. On the opposite face of the block 40 (not shown), the chamber 56 may be open or closed.

Figure 5:
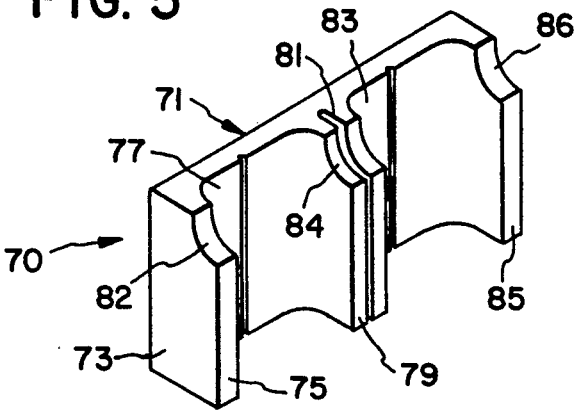
FIG. 5 shows an isometric view of a third block made in accordance with the teachings of the present invention.

With reference, now, to FIGS. 1 and 5, the block 70 is seen to include a bottom surface 71 which forms a continuous flat surface with bottom surfaces of the blocks 10, 40 and 10. The block 70 also includes side walls 71 and 87 as well as top surfaces 75, 79 and 85 with the top surface 79 having a centrally disposed slot 81 best facilitating dividing the block 70 in half if it is to be used on an end of a sequence.

The block 70 further includes cavities 77, 83 which are provided to receive mortar 60, 35 as well as rebar rods 57, 28.

Figure 2:
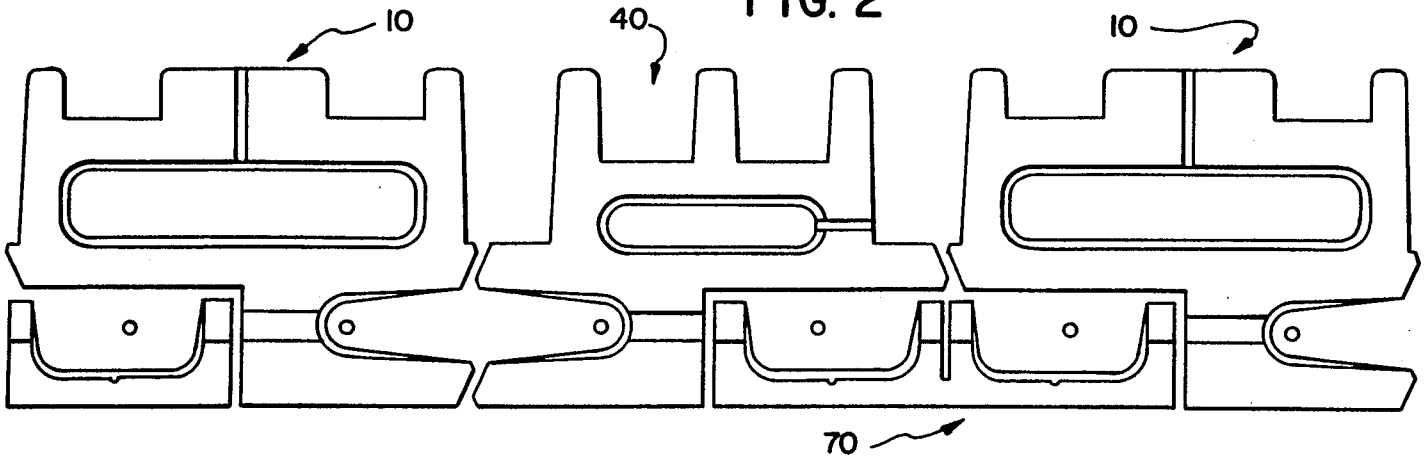
FIG. 2 shows a second embodiment of an acoustical diffusor made in accordance with the teachings of the present invention.

FIG. 2 shows blocks 10, 40, 10 and 70 which are identical to the blocks similarly numbered in FIGS. 1 and 3-5. FIG. 2 illustrates an alternative course of blocks wherein each of the blocks 10 and 40 is reversed 180° from its position and orientation as illustrated in FIG. 1. The block 70 is not shown reversed since its sole purpose is to interlock the blocks 10 and 40.

With reference to FIG. 1, a sequence is formed which consists of the values 1, 0, 1, 4, 2, 2, 4, 1, 0, 1. The invention as embodied in the diffusors illustrated in FIGS. 1 and 2 provides a multi-purpose structural acoustical block system providing both sound diffusion and low frequency sound absorption. The number theory sequence which is embodied in the blocks illustrated in FIGS. 1 and 2 provides the broad band width wide angle sound diffusion. The slots 25, 55 which allow access to the respective chambers 26, 56 provide low frequency cavity resonance. The block 70 provides strength and integrity when used in conjunction with mortar and rebar rods. The advantage of this structure over the prior art, especially, prior U.S. Pat. Nos. 4,964,486 and 5,027,920 is that the staggering of the well structures on the block faces in the prior patents is not necessary here. The structural integrity provided by the use of the blocks 70 obviates the need for the staggered structure taught in the prior patents.

A preferred mode of installation of the present invention would include the installation of a footing with vertical rebar reinforcement bars in place. The use of cavities such as the cavity designated by the reference numeral 14 allows the blocks to be lowered over the bars and to be "mortared" in place. Horizontal reinforcement bars may be horizontally inserted on alternate courses if required by building codes. After the blocks like the blocks 10 and 40 have been lowered and mortared, the blocks 70 may be inserted to provide the structural bond.

Of course, while the sequence of wells and dividers disclosed is one which is formed through operation of the quadratic-residue number theory sequence, other sequences may be created using different sequence formulae including primitive roots, Legendre polynomials, Zech logarithms or any sequence for which the Fourier transform of the exponentiated sequence depths is a constant or nearly so.

In a further aspect as above-mentioned, the entirety of the sequence illustrated in FIGS. 1 and 2 may be created by a single one-piece block having side cavity structure similar to the cavity 14 and the cavity created by the walls 23, 53 to allow adjacent blocks also comprising entire sequences to be attached together. Such structure is deemed to be within the teachings of the present invention.

As such, as invention has been disclosed in terms of preferred embodiments thereof which fulfill each and every one of the objects of the present invention as set forth hereinabove and provide a new and useful diffusing cinder block system of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

We claim:

1. A cinder block comprising:

a) a block having a first face having a plurality of wells, said wells being of particular depths with respect to one another which are determined by use of a quadratic-residue number theory sequence, wherein each consecutive well is given a number from 0 to n, where n equals one less than a total number of wells, and wherein a depth of any particular well is determined by squaring said number for said particular well and dividing said squared number by a chosen modulus number resulting in a remainder, the remainder after said dividing being multiplied by a chosen constant to arrive at said depth of said particular well;

b) said block having a second face on an opposite side of said block from said first face, said second face having a recess therein facilitating attachment of said block to an adjacent structure.

2. The invention of claim 1, wherein said plurality of wells comprises a portion of an entire sequence of wells.

3. The invention of claim 1, wherein said plurality of wells comprises an entire sequence of wells.

4. The invention of claim 1, wherein said block includes an internal low frequency sound absorbing chamber accessed via an access opening exposed to ambient atmosphere.

5. The invention of claim 4, wherein said access opening opens within one of said wells.

6. The invention of claim 5, wherein said one of said wells is of zero depth.

7. The invention of claim 4, wherein said access opening comprises a terminus of an elongated slot.

8. The invention of claim 7, wherein said slot is elongated in a direction parallel to a direction of elongation of a well of greater than zero depth.

9. The invention of claim 7, wherein said slot is elongated in a direction perpendicular to a direction of elongation of a well of greater than zero depth.

10. The invention of claim 1, wherein said adjacent structure comprises an adjacent block having a third face having a further plurality of wells therein being of particular depths with respect to one another which are determined by use of said quadratic-residue number theory sequence and a fourth face having a further recess therein which combines with said recess of said second face to form a securing chamber.

11. The invention of claim 10, wherein a locking block is contained in said securing chamber and locks said block and adjacent block together.

12. The invention of claim 11, wherein said locking block is fastened in said securing chamber through use of mortar and at least one reinforcement bar.

13. The invention of claim 10, wherein at least one well is formed by spaced walls on said block and adjacent block.

14. The invention of claim 11, wherein said locking block has a block dividing slot therein.

15. The invention of claim 10, wherein said chamber is generally rectangular cubic in shape.

* * * * *